United States Patent [19]

Remmers

[11] Patent Number: 5,074,223

[45] Date of Patent: Dec. 24, 1991

[54] FREE STANDING STACKING SHELF WITH COLLAPSIBLE LEGS

[75] Inventor: Lee E. Remmers, Ocala, Fla.

[73] Assignee: Clairson International, Ocala, Fla.

[21] Appl. No.: 585,652

[22] Filed: Sep. 20, 1990

[51] Int. Cl.[5] ..... A47B 3/08

[52] U.S. Cl. ..... 108/91; 211/199; 211/149; 108/125

[58] Field of Search ..... 108/91, 92, 125, 127; 211/130, 188, 194, 149, 181, 195

[56] References Cited

U.S. PATENT DOCUMENTS

| | | | |
|---|---|---|---|
| 72,228 | 12/1867 | Phillips | 108/131 X |
| 1,006,328 | 10/1911 | Widenhofer | 211/195 |
| 2,600,191 | 6/1952 | Beach | 211/194 |
| 3,184,075 | 5/1965 | Cohen | 108/91 X |
| 3,217,671 | 11/1965 | Walsh | 108/91 |
| 3,747,539 | 7/1973 | Calzaretto | 108/91 |
| 4,444,320 | 4/1984 | Chap | 211/194 X |
| 4,732,284 | 3/1988 | Remmers | 108/91 X |
| 4,915,238 | 4/1990 | Cassel | 211/194 |

*Primary Examiner*—Peter A. Aschenbrenner

*Attorney, Agent, or Firm*—Cushman, Darby & Cushman

[57] ABSTRACT

A free standing stacking shelf system is provided wherein the stacking elements of each shelf are selectively collapsible or foldable with respect to the shelf and can be selectively locked into a predetermined angular disposition with respect to the shelf element. Each of the stacking elements is substantially U-shaped having first and second legs and a base extending therebetween. The free ends of the legs are pivotally coupled to a respective shelf. A device is provided for selectively locking the legs and hence the stacking element with respect to the shelf in a predetermined orientation. When the legs are unlocked from the shelf element, the stacking elements can be collapsed or folded so as to be closely adjacent to the shelf element thereby significantly reducing the overall height of the shelf for transport and storage.

23 Claims, 3 Drawing Sheets

FREE STANDING STACKING SHELF WITH COLLAPSIBLE LEGS

BACKGROUND OF THE INVENTION

1. Field of the Invention

The present invention relates to shelving systems and more particularly to a free standing stacking shelf system wherein the stacking shelves have collapsible legs which can be selectively locked in an upright position.

2. Description of the Related Art

Ventilated shelving systems are known which include a plurality of shelves, each shelf being formed from a pair of longitudinally extending side edge rods and a plurality of parallel transverse or cross bars which are fixedly coupled at each end thereof to the longitudinal rods. When such shelving systems are assembled and put in place for example within a closet, each of the shelves is mounted to the wall at vertically spaced intervals and/or are fixedly coupled at vertically spaced intervals to vertical poles. These shelving systems have the disadvantage that individual shelves are not free standing. Furthermore, such ventilated shelving systems may not be readily disassembled for moving the same and/or readily assembled so as to provide a different number of shelves in accordance with a particular consumer's varying needs.

A free standing stacking shelf system is proposed in earlier, commonly assigned U.S. Pat. No. 4,732,284. With that structure, stacking elements or legs are removably coupled to and extend downwardly from shelves of the shelving system and engage a next adjacent lower shelf so as to hold the shelves in a free standing, spaced relation. While such a free standing stacking shelf system provides a versatile shelf system and remedies certain deficiencies of conventional ventilated shelving systems, it is not to say that further improvements in ventilated shelving are not possible and indeed the present invention constitutes an improvement of such a free standing stacking shelf system.

More particularly, the above-noted free standing stacking shelf system provides legs or stacking elements which are coupled to a particular shelf so as to allow the same to be free standing and must be removed therefrom during shelf disassembly. However, it would be desirable to provide a free standing stacking shelf wherein the legs are selectively collapsible and selectively lockable into an upstanding disposition so that the shelves can be selectively collapsed for shipment, storage, and marketing and selectively locked in an upstanding disposition or free standing configuration when the shelf is to be assembled or otherwise placed in use. Another stacking shelf is known which has substantially rectilinear stacking elements fixedly mounted to each longitudinal end of a horizontal support surface. The stacking elements are configured so that a vertically lowermost portion of each stacking element can be interlocked to the vertically uppermost portion of a next adjacent lower stacking element which extends above the horizontal support surface of a next adjacent lower shelf.

Such stacking shelves again have the disadvantage that the legs are not collapsible or foldable into a compact storage configuration. In fact, the stacking elements of those stacking shelves cannot be removed from the associated shelf. Yet a further disadvantage of that structure is that the stacking element must be flexed inwardly, towards the stacking element disposed at the opposite longitudinal end of the shelf to enable interlocking of vertically adjacent shelves. Such flexing the of stacking elements stresses the interconnection of the horizontal support surface and the stacking element and can result in fracture of the assembly.

SUMMARY OF THE INVENTION

It is an object of the present invention to provide a free standing stacking shelf with which, for example the space above an existing shelf can be advantageously converted to usable shelf space to accommodate the varying and expanding requirements of the consumer, which free standing stacking shelf has legs extending downwardly therefrom which can be selectively collapsed prior to placing the free standing stacking shelf in use and/or between uses and wherein the stacking elements or legs of the free standing shelf can be selectively locked into a free standing configuration so as to allow reliable and sturdy mounting of the free standing stacking shelf.

The foregoing and other objects of the invention are realized by providing a free standing stacking shelf including a substantially planar support surface which is preferably defined by first and second longitudinally extending rod members and a plurality of transverse or cross bar members which are coupled at each end thereof to a respective longitudinal rod. Stacking elements or shelf legs are provided in accordance with the present invention and are in the form of first and second substantially U-shaped elements which have a substantially transverse base portion and first and second upstanding leg elements. The upstanding leg elements are operatively coupled to the planar support surface of the shelf so as to be pivotable with respect thereto. Further, means are provided for selectively locking the legs in a free standing configuration wherein they extend downwardly from the support surface in a plane substantially perpendicular to or at a predetermined angle with respect to the support surface of the shelf.

In accordance with the preferred embodiment of the invention, the vertically upper free end of each of the legs of the support structure includes a portion which extends longitudinally with respect to the longitudinal rods of the support surface of the shelf and has a ring element or eyelet structure defined at the distalmost end thereof. A pivot bar defined by a portion of the planar support surface or coupled thereto slidably receives the eyelet or ring element so that each support leg is pivotal relative to the planar support surface. In accordance with the invention, the support legs can be selectively locked in a predetermined position or angular disposition with respect to the planar support surface of the shelf. Thus, in accordance with the preferred embodiment, a lock bar is defined by a part of or mounted to the planar support surface and is selectively interlocked with a respective leg to lock the leg in a predetermined disposition.

Other objects, features, and characteristics of the present invention as well as the methods of operation and functions of the related elements of structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENT

Figure 1:
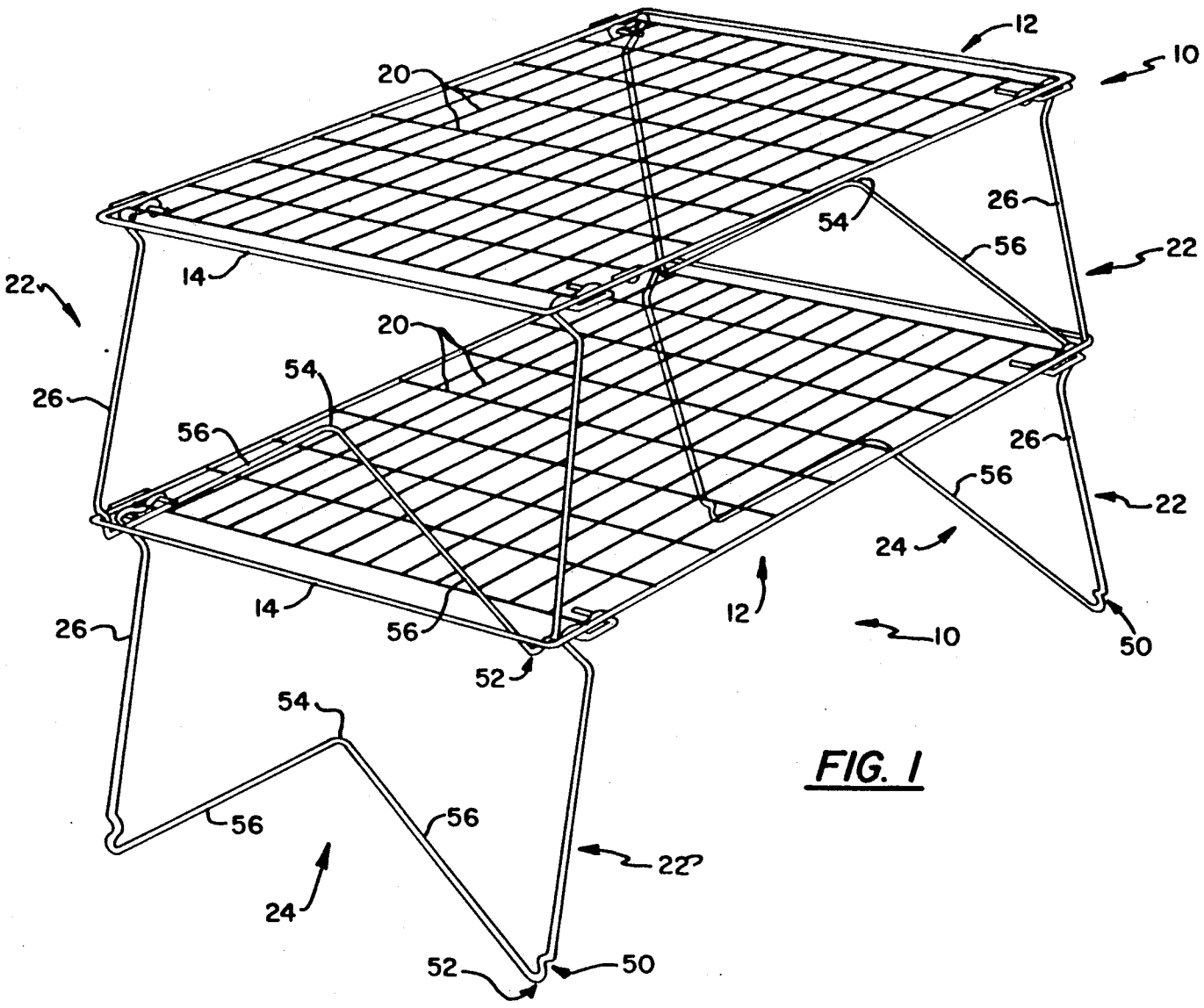
FIG. 1 is a perspective view from above of first and second stacking shelves provided in accordance with the present invention mounted atop one another.
Figure 2:
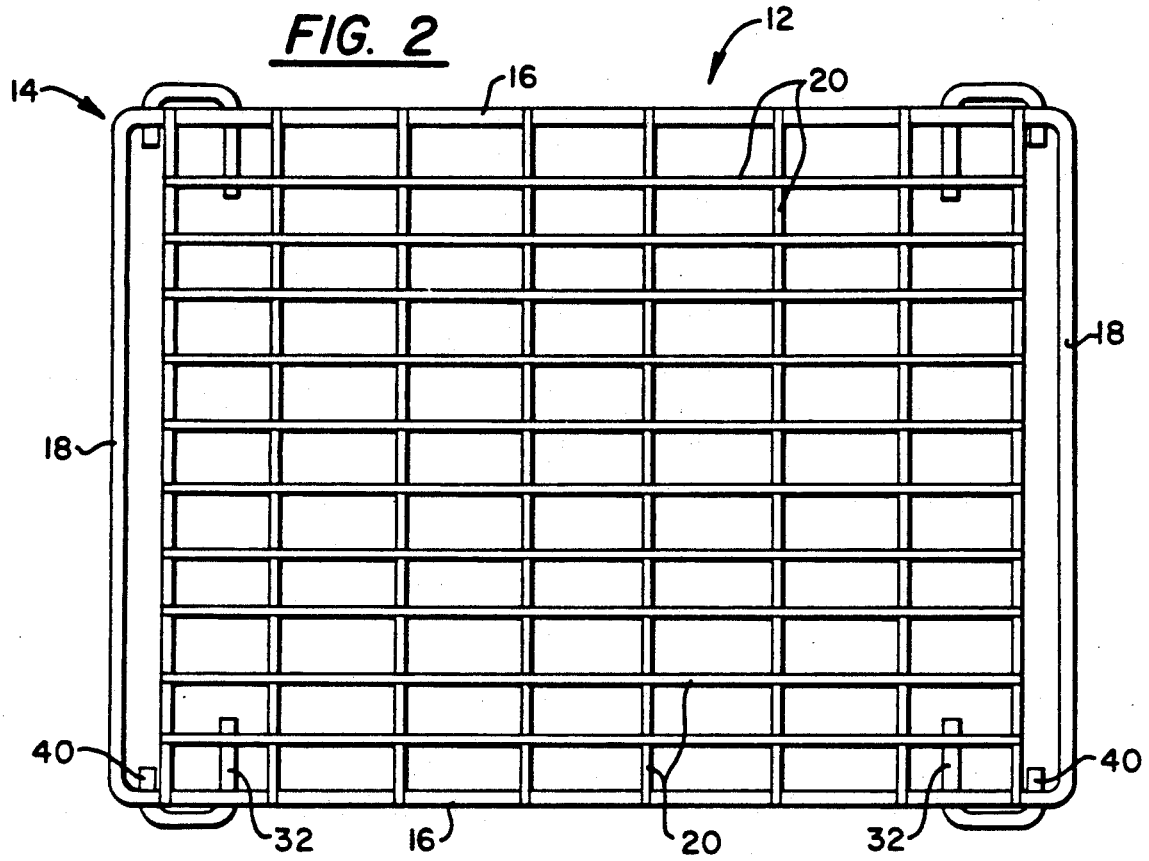
FIG. 2 is a top plan view of a shelf element provided in accordance with the present invention.

A free standing stacking shelf 10 in accordance with the present invention is shown in its assembled, stacked configuration in FIG. 1. As can be seen, each stacking shelf includes a shelf element 12 which defines a horizontal support surface for receiving folded garments, cleaning supplies, food products or the like. In the illustrated embodiment, the shelf element 12 is defined by a frame 14 formed by a generally rectilinear rod element which includes first and second longitudinal side rod portions 16 and first and second transverse end rod portions 18 (FIG. 2). A grid 20 of transverse and longitudinal rods defines the support surface of the shelf and is interconnected at least with the longitudinal side rod portions 16 defining the frame of the shelf element 12. In the illustrated embodiment, the longitudinal and transverse rod elements of grid 20 have a cross-section which is reduced as compared to the rods defining the frame 14. It is to be appreciated, however, that horizontal support surfaces having a configuration other than that shown can be employed in accordance with the present invention. For example, the shelf element can have first and second longitudinal rods defining its longitudinal side edges and a plurality of cross bar or transverse rods coupled to and extending between the longitudinal rods to define a horizontal support surface for goods. As a further alternative, the transverse rod portions can be curved or wavy along their lengths so that the shelf element is more aesthetically pleasing and ornamental in its appearance. Likewise, the rods defining the grid can be disposed so as to be other than parallel or perpendicular with respect to one another so as to provide an ornamentally geometric shelf surface. Thus, the shelf element, at a minimum, need only include first and second longitudinal rods defining its longitudinal side edges and a plurality of cross bars coupled to and extending between the longitudinal rods to define a horizontal support surface.

As shown in FIG. 1, in accordance with the preferred embodiment of the present invention, each shelf element 12 is provided with first and second stacking elements or leg assemblies 22. In the illustrated embodiment, each stacking element or leg assembly 22 is a substantially U-shaped element including a base element 24 and first and second leg elements 26.

In accordance with the illustrated embodiment, the distal end of each leg element 26 of each substantially U-shaped element 22 is removably mounted to the shelf element 12 so as to be pivotal with respect thereto and selectively lockable in a desired angular disposition with respect to the shelf element, as discussed more fully below.

More particularly, as shown the distal end portion 28 of each leg element 26 extends substantially longitudinally with respect to the longitudinal axis of the shelf element 12. The longitudinally extending portion of each leg element terminates in an arcuate portion 30 which may be in the form of a closed loop or simply curved with respect to distal end portion 28 so as to selectively slidably receive a pivot rod 32 which one of defines a portion of the shelf element 12 or is fixedly mounted thereto, as described more fully below.

In the illustrated embodiment, each leg element 26 includes first and second longitudinal portions 34, 36, the second, vertically upper longitudinal portion 36 terminating in the arcuate, rod receiving element 30. The first and second longitudinal portions 34, 36 are defined at an angle with respect to each other so as to define a locking rod receiving portion 38, as described more fully below.

Figure 3:
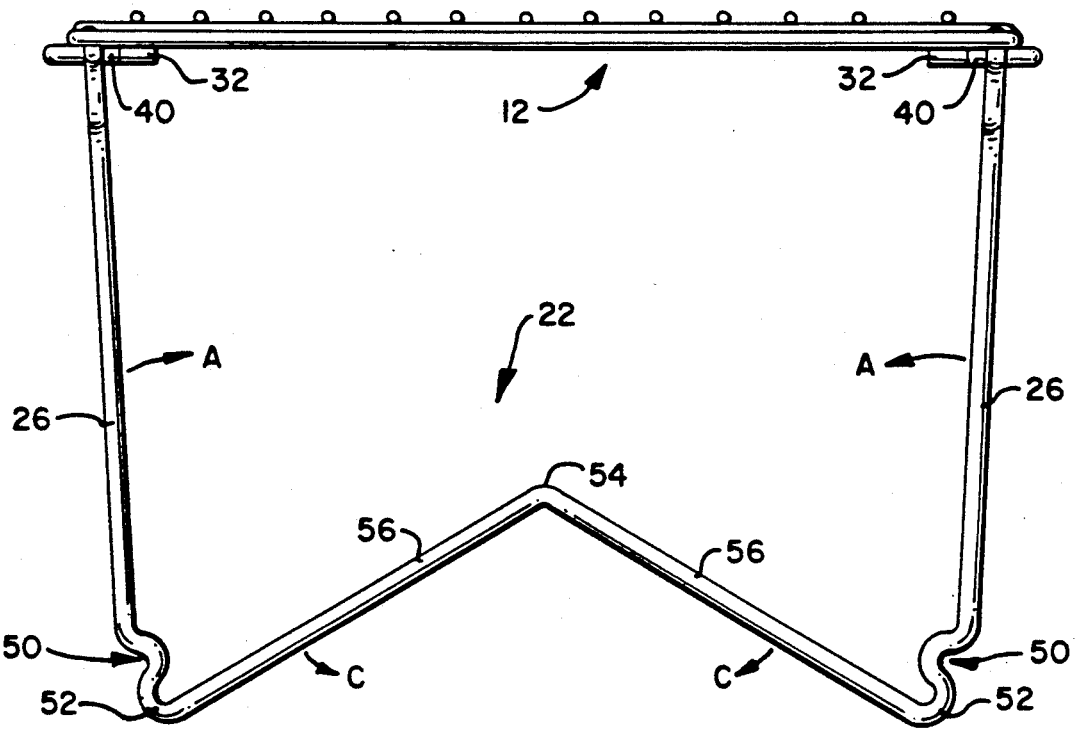
FIG. 3 is an end elevational view of a shelf element with a U-shaped leg in accordance with the invention mounted and locked with respect thereto.

Referring to FIG. 3 in particular, the leg elements 26 of each U-shaped stacking element 22 can be pivoted with respect to the base element 24 of the stacking element 22 as shown by arrows A, by virtue of the inherent resiliency of the material forming the stacking element. Thus, when the leg elements 26 are to be mounted to the shelf element 12, the U-shaped stacking element 22 is flexed so that the legs 26 are displaced inwardly as shown by arrows A and the arcuate portion 30 of each leg is aligned with and slidably receives a pivot bar 32 of the respective shelf element.

Figure 4:
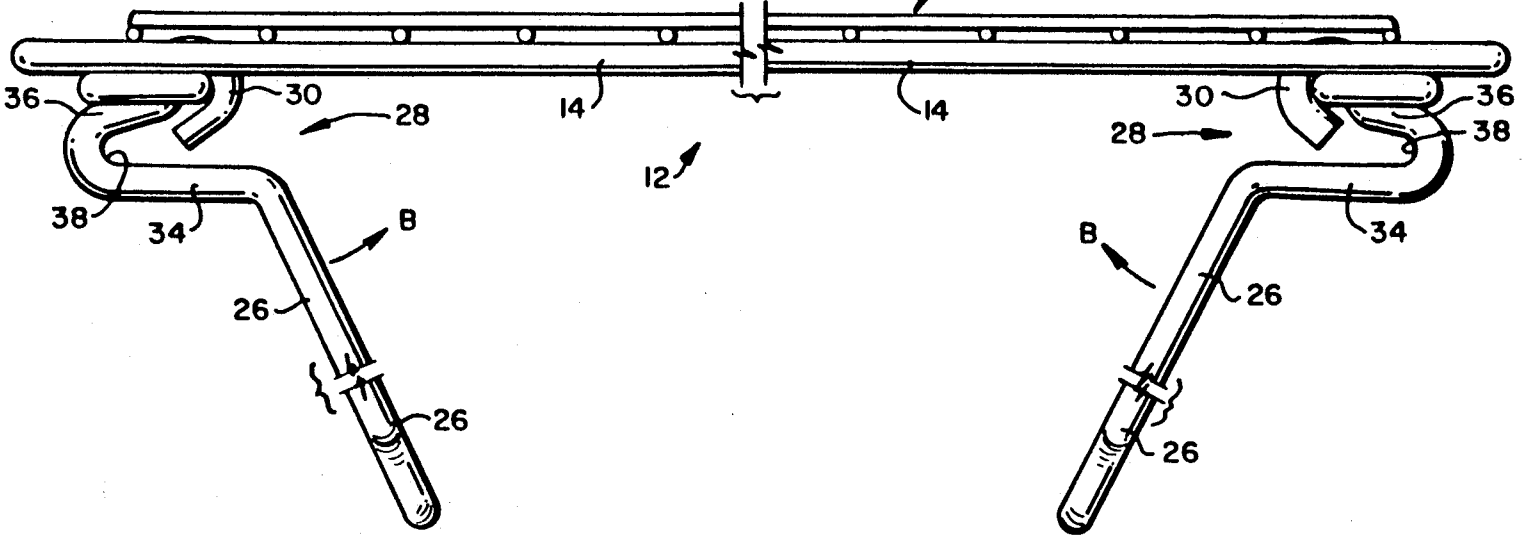
FIG. 4 is a side elevational view of a stacking shelf in accordance with the present invention in an unlocked, foldable configuration.

When the flexure of the leg elements 26 of the stacking element 22 is released, then, pivot bar 32 is received in arcuate portion 30 resulting in a pivotal interconnecting of U-shaped stacking element 22 to the respective shelf element 12 as shown, for example, in FIG. 4. The leg elements 26 of the U-shaped stacking element 22 can then be pivoted as shown by arrows B with respect to the plane of the shelf element 12, about the pivot bar 32.

Figure 5:
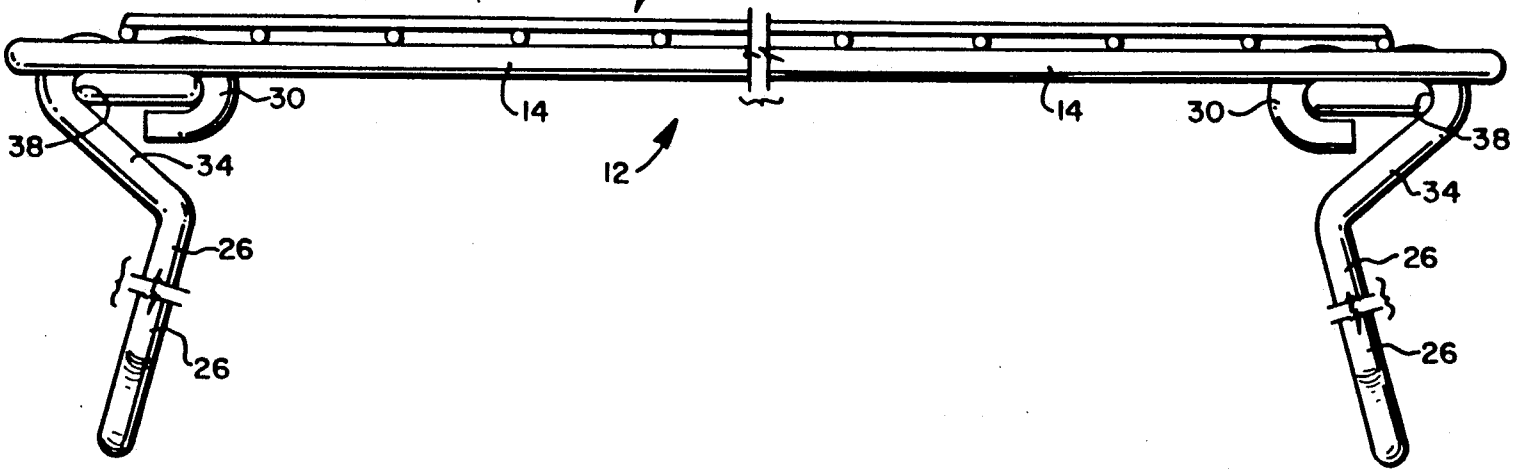
FIG. 5 is a side elevational view of a stacking shelf in accordance with the present invention in a locked, free standing configuration.

As is apparent from a consideration of FIGS. 2–4, a locking bar 40 prevents pivotal motion of the stacking elements 22 with respect to the shelf element 12 all the way into the freestanding disposition shown in FIGS. 1 and 5. However, the legs can be collapsed with respect to the shelf element in the direction of arrow B in FIG. 4 so as to be disposed in a plane substantially parallel to the shelf element 12 and immediately adjacent to the same.

When it is desired to lock the legs 26 of the stacking shelf 10 with respect to the shelf element 12 in the disposition as shown in FIG. 1, the leg elements 26 of each U-shaped stacking element 22 are flexed slightly inwardly in the direction of arrows A in FIG. 3 so that the second rod receiving portion 38 can be pivoted into alignment with the end of the locking rod 40. As can be seen from a comparison of FIG. 2 and 3, because the pivot rod 32 extends transversely beyond the locking rod 40, slight deflection of the legs 26 in this manner maintains the leg elements 26 in engagement with pivot rods 32 and hence, maintains the pivotal mounting of the leg elements 26 to the shelf element 12 but allows the above-mentioned alignment of the receiving recesses 38 with the locking rods 40. Pivoting the legs 26 into alignment with locking rod 40 and then releasing the inward flexure of the legs 26 allows the rod receiving portions 38 to engage and receive the respective locking rods 40 thereby locking the legs 26 of the U-shaped stacking element 22 in a predetermined angular orientation with respect to the shelf element 12 as shown in FIGS. 1 and 5. When it is desired to unlock the legs, the legs are simply pivoted as shown by arrow A until the arcuate locking rod receiving portion 38 is disengaged from the locking rod 40 followed by pivoting the legs in the direction of arrow B. If the legs are further flexed in the direction of arrow A, then complete removal of the legs from the shelf element is possible.

As shown in FIG. 3, the proximal ends of the legs 26 of the stacking elements 22 are curved as at 50 so as to define a longitudinal side rod receiving portion for selectively engaging a longitudinal side edge rod 16 of a next adjacent lower shelf. The longitudinal side rod receiving portions 50 of the stacking element 22 are laterally spaced from one another a distance corresponding to the lateral spacing of the longitudinal side rods of the next adjacent shelf. Accordingly, in order to mount the stacking element to the next adjacent shelf, it is necessary to flex the vertically lower or proximal portions of the legs 26 towards one another an amount sufficient to enable the vertically lowermost portion of the shelf shown generally at 52 to be inserted between the longitudinal side rods 16 and to extend below the longitudinal side rods 16 so that the longitudinal side rods are snugly received in their respective recesses 50. Such flexure of the base 24 of the stacking element 22 is made possible in accordance with the preferred embodiment of the invention by defining the base portion 24 so as to have a flexure locus shown generally at 54. More particularly, by providing first and second angularly offset portions 56 for the base element 24, flexure in the direction shown by arrow C, although slight, is possible in accordance with the invention. To facilitate flexure of the base element 24, base portions 56 are preferably disposed at an angle of between about 60 and 180 degrees and most preferably about 90 to 120 degrees.

Providing a structure wherein the stacking element itself is selectively flexed to allow a locking interconnection, avoids the disadvantages of stress concentration at the coupling of the stacking element to the shelf element, as in the prior art.

Further, providing a straight base portion extending between the proximal portions of the legs will inhibit flexure of the proximal portions of the legs with respect to one another.

It is to be understood, however, that the stacking elements 22 need not be configured so as to allow locking interconnection to a next adjacent shelf element. Thus, for example, an L-shaped seat (not shown) can be defined at the proximal end of the legs of the U-shaped stacking element for sitting atop a longitudinal side rod of a next adjacent shelf and a substantially straight base portion can be provided. As yet a further alternative, the L-shaped seat can be defined in a plane parallel to the longitudinal axis of the shelf element for seating upon a transverse or cross bar of a next adjacent shelf. However, it is envisioned that a locking mounting structure has shown for example in FIGS. 1 and 3 advantageously provides stacking shelves which may be locked together to form a unitary shelving system.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A free-standing stacking shelf system comprising:

at least two shelf elements;

at least two stacking elements coupled to each of said at least two shelf elements and extending downwardly therefrom, each said stacking element being substantially U-shaped, having first and second upwardly extending leg elements and a base element coupled to and disposed between a lower end of said first and second leg elements;

means for pivotally coupling each said leg element of each said stacking element to said respective shelf element; and means for selectively locking each said stacking element with respect to said respective shelf element so as to substantially prevent pivotal movement of said stacking element with respect to said shelf element, said means for selectively locking including a lock bar receiving portion defined said shelf element and said leg element and a lock bar element provides on the other of said shelf element and said leg element.

2. A system as in claim 1, wherein said means for pivotally coupling includes an arcuate pivot rod receiving portion defined on one of said shelf element and said leg element and a pivot rod element defined on the other of said shelf element and said leg element.

3. A system as in claim 2, wherein each leg element of each said stacking element has a distal portion extending substantially longitudinally with respect to said respective shelf element and terminating distally in a said arcuate pivot rod receiving portion for slidably receiving a pivot rod element mounted to said respective shelf element and extending in a direction substantially transverse to a longitudinal axis of said shelf element.

4. A system as in claim 1, wherein said lock bar is mounted to said shelf element so as to extend substantially transversely with respect to a longitudinal axis of said shelf element, said leg element having an arcuate lock bar receiving port defined along the length thereof for selectively engaging said lock bar.

5. A system as in claim 3, wherein said lock bar is mounted to said shelf element so as to extend substantially transversely with respect to a longitudinal axis of said shelf element, said leg element having an arcuate lock bar receiving portion defined along the length thereof for selectively engaging said lock bar.

6. A system as in claim 5, wherein said lock bar element has a length less than a length of said pivot rod element 7. A system as in claim 3, wherein said leg element includes first and second portions which extend substantially longitudinally with respect to said longitudinal axis of said shelf element.

8. A system as in claim 6, wherein said leg element includes first and second portions which extend substantially longitudinally with respect to said longitudinal axis of said shelf element.

9. A system as in claim 8, wherein a juncture of said first and second longitudinally extending portions defines said arcuate lock bar receiving portion.

10. A system as in claim 1, wherein said base element of each said stacking element includes first and second base portions, said base portions being disposed at an angle of between about 60 degrees and about 180 degrees with respect to one another.

11. A system as in claim 1, further comprising means for locking the stacking elements of an upper of said shelf elements to a next adjacent, lower of said shelf elements.

12. A system as in claim 11, wherein each said shelf element comprises first and second longitudinal side rod elements and a plurality of cross bars coupled to and extending between said longitudinal side rod elements.

13. A system as in claim 12, wherein said means for locking to an adjacent, lower shelf includes recess means for selectively engaging longitudinal side rod elements of a next adjacent, lower shelf element.

14. A free-standing stacking shelf comprising:

a shelf element;

at least two stacking elements coupled to said shelf element and extending downwardly therefrom, each said stacking element being substantially U-shaped, having first and second upwardly extending leg elements and a base element coupled to and disposed between a lower end of said first and second leg elements;

means for pivotally coupling each said leg element of each said stacking element to said shelf element; and means for selectively locking each said element with respect to said shelf element so as to substantially prevent pivotal movement of said stacking element with respect to said shelf element, said means for selectively locking including a lock bar receiving portion defined on one of said shelf element and said leg element and a lock bar element provided on the other of said shelf element and said leg element.

15. A shelf as in claim 14, wherein said means for pivotally coupling includes an arcuate pivot rod receiving portion defined on one of said shelf element and said leg element and a pivot rod element defined on the other of said shelf element and said leg element.

16. A shelf as in claim 15, wherein each leg element of each said stacking element has a distal portion extending substantially longitudinally with respect to said shelf element and terminating distally in a said arcuate pivot rod receiving portion for slidably receiving a pivot rod element mounted to said shelf element and extending in a direction substantially transverse to a longitudinal axis of said shelf element.

17. A shelf as in claim 16, wherein said lock bar is mounted to said shelf element so as to extend substantially transversely with respect to a longitudinal axis of said shelf element, said leg element having an arcuate lock bar receiving portion defined along the length thereof for selectively engaging said lock bar.

18. A shelf as in claim 17, wherein said lock bar element has a length less than a length of said pivot rod element.

19. A shelf as in claim 18, wherein said leg element includes first and second portions which extend substantially longitudinally with respect to said longitudinal axis of said shelf element.

20. A shelf as in claim 19, wherein a juncture of said first and second longitudinally extending portions defines said arcuate lock bar receiving portion.

21. A shelf as in claim 14, wherein said base element of each said stacking element includes first and second base portions, said base portions being disposed at an angle of between about 60 degrees and about 180 degrees with respect to one another.

22. A system as in claim 14, wherein said shelf element comprises first and second longitudinal side rod elements and a plurality of cross bars coupled to and extending between said longitudinal side rod elements.

23. A free-standing stacking shelf system comprising:

at least two shelf elements;

at least two stacking elements coupled to each of said at least two shelf elements and extending downwardly therefrom, each said stacking element being substantially U-shaped, having first and second upwardly extending leg elements and a base element coupled to and disposed between a lower end of said first and second leg elements;

means for pivotally coupling each said leg element of each said stacking element to said respective shelf element;

means for selectively locking each said stacking element so as to substantially prevent pivotal movement of said stacking element with respect to said shelf element;

means for locking stacking elements of an upper of said shelf elements to a next adjacent, lower of said shelf elements, each said shelf element comprising first and second longitudinal side rod elements and a plurality of cross bars coupled to and extending between said longitudinal side rod elements.

* * * * *